US005930874A

United States Patent [19]

Yamazaki et al.

[11] Patent Number: 5,930,874

[45] Date of Patent: Aug. 3, 1999

[54] PULL-TAB CONNECTOR FOR SLIDE FASTENER SLIDER

[75] Inventors: Miki Yamazaki; Masato Yokota, both of Toyama-ken, Japan

[73] Assignee: YKK Corporation, Tokyo, Japan

[21] Appl. No.: 09/162,990

[22] Filed: Sep. 30, 1998

[30] Foreign Application Priority Data

Sep. 30, 1997 [JP] Japan ..... 9-266530

[51] Int. Cl.[6] ..... A44B 19/26; A44B 11/10

[52] U.S. Cl. ..... 24/429; 24/431; 24/419

[58] Field of Search ..... 24/429, 419, 415, 24/431, 300, 301; 294/3.6

[56] References Cited

U.S. PATENT DOCUMENTS

| | | | |
|---|---|---|---|
| 4,985,969 | 1/1991 | Terada et al. | 24/429 |
| 5,187,841 | 2/1993 | Takemura et al. | 24/429 |
| 5,771,546 | 6/1998 | Minato | 24/429 |

FOREIGN PATENT DOCUMENTS

| | | |
|---|---|---|
| 0809 953 | 12/1997 | European Pat. Off. . |
| 504129 | 6/1920 | France . |
| 43707 | 8/1934 | France . |
| 2 735 955 | 1/1997 | France . |

OTHER PUBLICATIONS

Patent Abstracts of Japan, vol. 098, No. 03, Feb. 27, 1998 and JP 09 285318, 1 page.

*Primary Examiner*—James R. Brittain
*Assistant Examiner*—Robert J. Sandy
*Attorney, Agent, or Firm*—Hill & Simpson

[57] ABSTRACT

A pull-tab connector capable of attaching a pull tab with a flat or round strap, simply. A connecting ring, which is adapted to be attached to a slider body, is connected to an outer side of a central frame of a U-shaped bracket of the connector. Opposite side frames of the U-shaped bracket have a pair of horizontal slots in which a strap-turning bar is slidably and rotatably received and a pair of axial holes in which a strap-insertion bar is rotatably received. The strap-insertion bar has a strap-insertion through-hole. In use, the strap is firstly threaded through the strap-insertion through-hole of the strap-insertion bar and is then turned around the strap-turning bar, and finally pulled out from the strap-insertion through-hole again. The opposite ends of the strap are pulled to be aligned with each other. Then, the strap can be attached to the connector in a simple operation and is exchangeable with another strap as desired.

12 Claims, 6 Drawing Sheets

PULL-TAB CONNECTOR FOR SLIDE FASTENER SLIDER

BACKGROUND OF THE INVENTION

1. Field of the Invention

The present invention relates to a pull-tab connector for connecting a pull tab in the form of a flat or round strap to a slide fastener slider.

2. Description of the Related Art

FIG. 11 of the accompanying drawings shows a conventional pull-tab connector of this type. The pull-tab connector comprises a plate-like pull tab 30' having at one end a connecting hole 70' to be attached to an attachment lug of a slider body and at the other end a comb-like grip portion 31' provided with a number of through-holes 11' through which a flat strap is fixedly threaded meanderingly.

Japanese Utility Model Laid-Open Publication No. Hei6-50514 discloses a pull-tab connector, as shown in FIG. 12 of the accompanying drawings. The pull tab connector comprises a clamp member 20" in the form of a pair of rectangular holder plates 22" interconnected at one side by a neck 27" and having on each of their confronting inner surfaces a pair of grooves having projections, a connecting ring 7" connected to the neck 27" of the clamp member 20" and adapted to be attached to the slider body, and a round strap 4" of which ends are received in the grooves and clamped between the holder plates 22" of the clamp member 20".

According to the first-named conventional pull-tab connector of FIG. 11, although the pull tab 30' can be manufactured in a very simple manner, smooth turning and threading of the strap 4' with respect to the pull tab 30' is difficult to achieve. Also the strap 4' threaded through the grip portion 31' of the pull tab 30' partly protrude from the opposite pull tab surfaces, making the pull tab unsightly.

According to the second-named conventional pull-tab connector of FIG. 12, although the ends of the round strap 4" can be secured to the clamp member 20" firmly and neatly, it is laborious and time-consuming to attach the strap 4" to the clamp member 20". Besides, once the ends of the strap 4" has been attached to the clamp member 20", it is difficult to exchange the strap 4" with another.

SUMMARY OF THE INVENTION

With the foregoing problems in view, a first object of the present invention is to provide a pull-tab connector for a slide fastener slider, in which a pull tab using a flat or round strap can be attached to a slider body in a simple operation and the attached strap can be exchanged with another simply as desired. Specifically, after the strap has been threaded through and turned in a U-shaped bracket of the connector, the strap ends are set aligned, the strap can be fastened only by pulling.

A second object of the invention is to provide a pull-tab connector for a slide fastener slider, in which the strap can be threaded through and turned in the U-shaped bracket simply and smoothly by using a strap-turning bar and a strap-insertion bar, at least one of which is rotatably and/or slidably supported by the bracket.

A third object of the invention is to provide a pull-tab connector for a slide fastener slider, in which the strap can be threaded and turned in the U-shaped bracket in a stable posture by using a strap-turning bar and a strap-insertion bar, at least one of which is fixed to the bracket.

A fourth object of the invention is to provide a pull-tab connector for a slide fastener slider, in which each of the strap-turning bar and the strap-insertion bar supported by the U-shaped bracket has a structure suitable for threading a round strap in particular.

A fifth object of the invention is to provide a pull-tab connector for a slide fastener slider, in which the pull-tab connector through which the strap has been threaded can be attached to the slider body simply and in which operation and handling of the slider can be facilitated.

A sixth object of the invention is to provide a pull-tab connector for a slide fastener slider, in which free ends of the strap threaded through and turned in the U-shaped bracket can be held neatly and fixedly by a fastener, facilitating pulling the slider.

A seventh object of the invention is to provide a pull-tab connector for a slide fastener slider, in which free ends of the strap threaded through and turned in the U-shaped bracket can be neatly and fixedly held by a fastener in a simple snap action.

An eighth object of the invention is to provide a pull-tab connector for a slide fastener slider, in which free ends of the strap threaded through and turned in the U-shaped bracket can be held neatly and fixedly by a fastener without accidental removal.

A ninth object of the invention is to provide a pull-tab connector for a slide fastener slider, in which the pull tab can be gripped by fingers without skidding.

In order to achieve the foregoing objects, according to a first aspect of the invention, there is provided a pull-tab connector for connecting a strap of a pull tab to a slide fastener slider, comprising: a U-shaped bracket having a pair of opposite side frames and a central frame extending between the opposite side frames; a connector ring connected to an outer surface of the central frame of the U-shaped bracket, the connector ring being adapted to be attached to a pull-tab attachment lug of the slide fastener slider; a strap-turning bar supported by the U-shaped bracket centrally between the opposite side frames for turning the strap around the strap-turning bar; and a strap-insertion bar supported by the U-shaped bracket between respective free ends of the opposite side frames and having a first strap-insertion through-hole through which the strap is to be inserted.

According to a second aspect of the invention, the strap-insertion bar is rotatably supported on the opposite side frames of the U-shaped bracket for rotating about its own axis.

According to a third aspect of the invention, the opposite side frames of the U-shaped bracket have a pair of slots in and along which the strap-turning bar is slidably and rotatably received.

According to a fourth aspect of the invention, the strap-turning bar is fixed to the opposite side frames of the U-shaped bracket.

According to a fifth aspect of the invention, the strap-insertion bar is fixed to the opposite side frames of the U-shaped bracket.

According to a sixth aspect of the invention, the strap-turning bar has a pair of laterally spaced second strap-insertion holes through which the strap is to be inserted.

According to a seventh aspect of the invention, the central frame of the U-shaped bracket has on its outer surface a pair of bearing lugs on which the connector ring is pivotally supported.

According to an eighth aspect of the invention, the pull tab further includes a strap-end clamp member composed of a base and a holder plate. The strap is threaded through the strap-insertion bar of the U-shaped bracket and then turned by the strap-turning bar and is clamped at its ends between the base and holder plate of the strap-end clamp.

According to a ninth aspect of the invention, the holder plate has a pair of resilient angled legs and the base has a pair of catch holes engageable with the angled legs.

According to tenth aspect of the invention, the base and/or the holder plate have/has on its inner surface a plurality of spikes for biting into the strap when the base and the holder plate are pressed toward each other to clamp the strap.

According to eleventh aspect of the invention, the base and/or the holder plate have/has on its outer surface a plurality of grooves.

DETAILED DESCRIPTION OF THE PREFERRED EMBODIMENTS

The principle of the present invention is particularly useful when applied to a pull-tab connector for a slide fastener slider, various preferred embodiments of which will now be described in detail with reference to the accompanying drawings.

Figure 1:
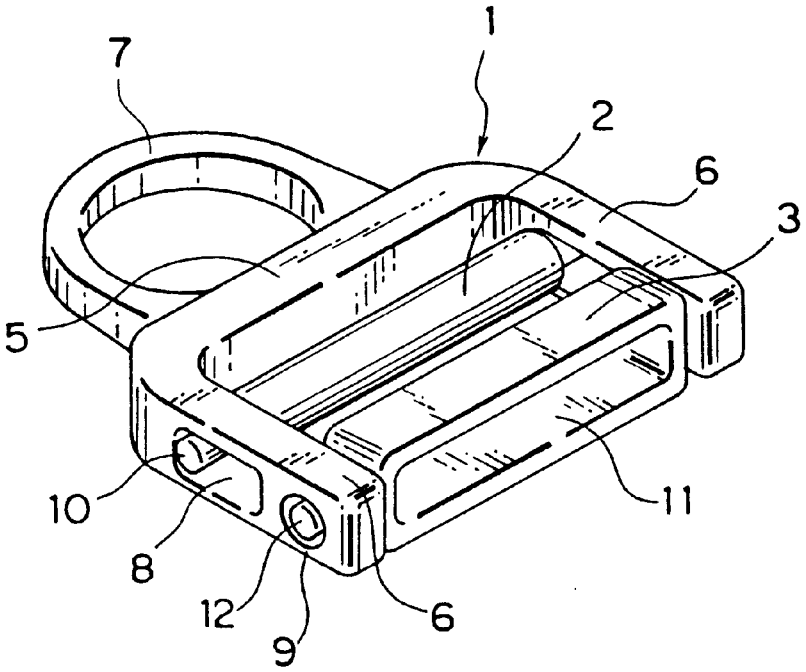
FIG. 1 is a perspective view of a U-shaped bracket of a pull-tab connector for a slide fastener slider, according to a first embodiment of the present invention.

The pull-tab connector of the present invention basically comprises, as shown in FIG. 1, a generally U-shaped bracket 1, and a connecting ring 7 projecting from an outer surface of a central frame 5 of the U-shaped bracket 1 and adapted to be attached to a slider body S. Opposite side frames 6 of the U-shaped bracket 1 have a pair of horizontal rectangular slots 8 at their respective centers and a pair of circular pivot holes 9 near at their respective free ends.

A strap-turning bar 2 in the form of a cylindrical rod has at opposite ends a pair of pivots 10 to be received in the respective slots 8 of the opposite side frames 6 and is thereby slidably and rotatably supported by the opposite side frames 6. Likewise a strap-insertion bar 3 of a square-cross-section has at opposite ends a pair of pivots 12 to be received in the respective pivot holes 9 of the opposite side frames 6 and is thereby rotatably supported by the opposite side frames 6. The strap-insertion bar 3 has a rectangular strap-insertion through-hole 11 extending over the majority of its entire length so that the strap 4 may be inserted through the strap-insertion through-hole 11 as described later.

The pull-tab connector, with the strap-turning and strap-insertion bars 2, 3 being supported between the opposite side frames 6 of the U-shaped bracket, is manufactured simultaneously by die-casting of metal such as aluminum alloy or zinc alloy. Alternatively, the pull-tab connector may be molded by injection molding using thermoplastic synthetic resin, such as polyamide, polyacetal, polypropylene or polybutylene-telephthalate, instead of metal.

Figure 2:
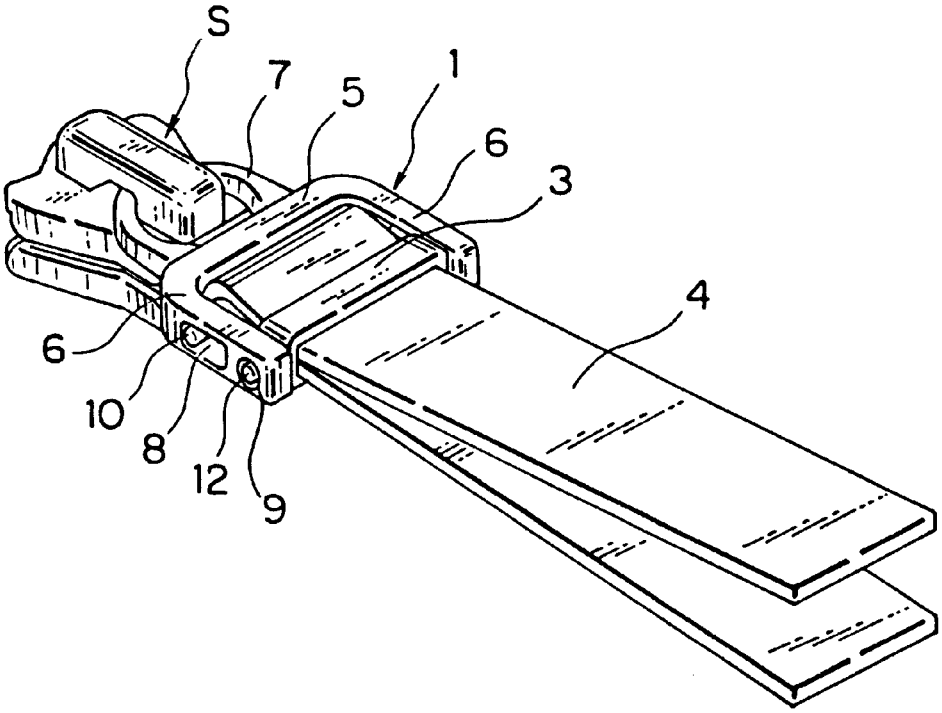
FIG. 2 is a perspective view showing the pull-tab connector of the first embodiment as attached to the slider.
Figure 3A:
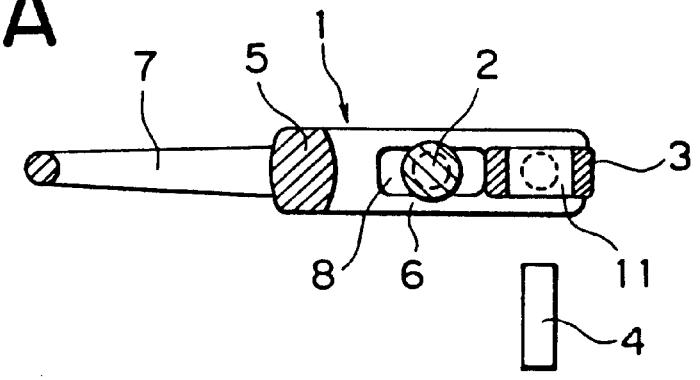
FIGS. 3A through 3D are cross-sectional views schematically showing steps in which a strap is threaded through and turned in the U-shaped bracket.
Figure 3B:
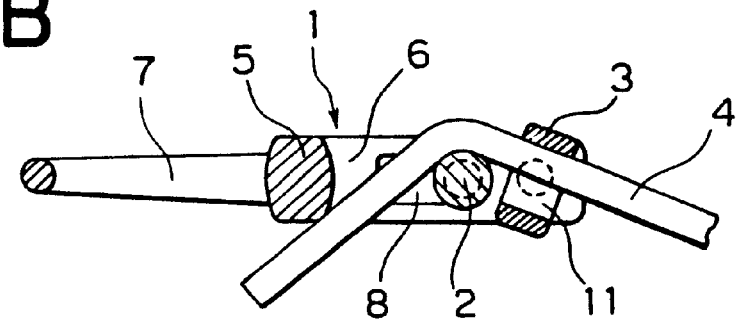
Figure 3C:
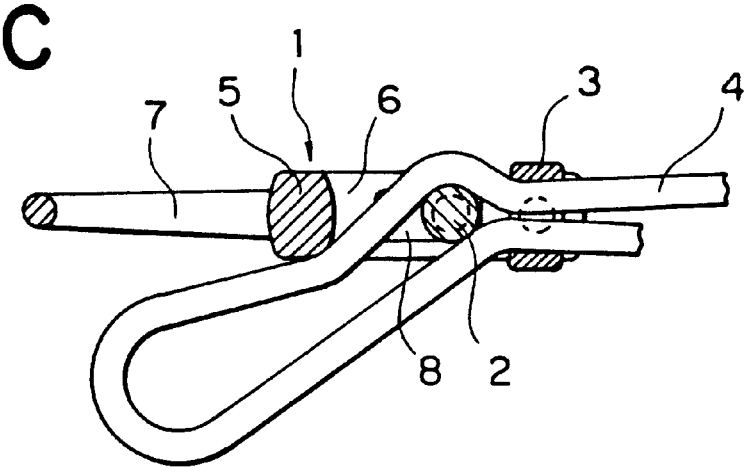

The steps in which the strap 4 in the form of a flat strip is threaded through the U-shaped bracket 1 will now be described with reference to FIGS. 3A through 3D. Firstly a leading end of the flat strap 4 is inserted through the through-hole 11 of the strap-insertion bar 3 and is then inserted through the space between the strap-turning bar 2 and the central frame 5 of the U-shaped frame 1 from the upper side of the strap-turning bar 2 as shown in FIG. 3B. At that time, the strap-insertion bar 3 is pivotally moved or tilted toward the strap-turning bar 2 as shown in FIG. 3B. Then the leading end of the strap 4 is inserted through the through-hole 11 of the strap-insertion bar 3 after turning around the strap-turning bar 2 as shown in FIG. 3C. Finally, the leading end of the strap 4 is drawn outwardly from the strap-insertion bar 3 until it comes into vertical alignment with its trailing end, whereupon the two aligned ends of the strap 4 are drawn further to pull the strap-turning bar 2 toward the strap-insertion bar 3 by the strap loop, thus tightening the strap 4. In the meantime, the connector ring 7 is attached to the slider body S. Thus the pull tab of FIG. 2 has been completed.

Figure 3D:
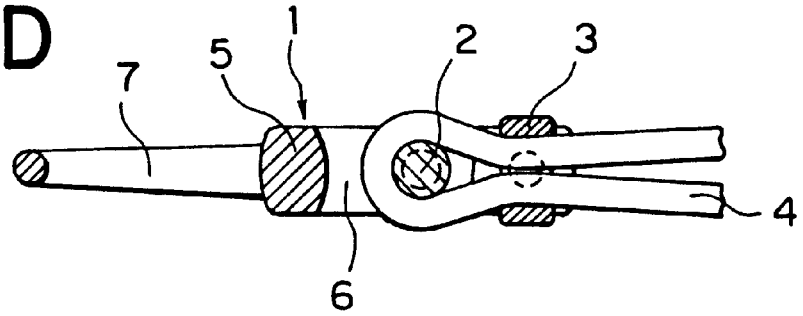
Figure 4:
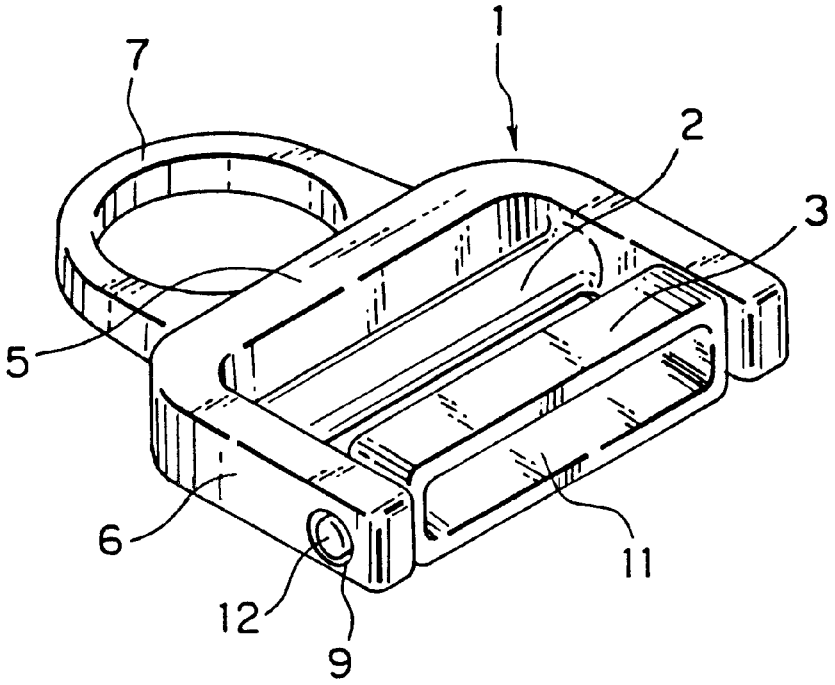
FIG. 4 is a perspective view of another pull-tab connector according to a second embodiment of the invention.

FIG. 4 shows another pull-tab connector according to a second embodiment. This embodiment is identical with the first embodiment of FIG. 1 except that a strap-turning bar 2 is fixed at opposite ends as shown in FIG. 3D to opposite side frames 6 of a modified U-shaped bracket 1 of the connector, which is devoid of a longitudinal slot in each of the side frame 6. A strap-insertion bar 3 has at opposite ends a pair of pivots 12 which are rotatably received in the respective pivot holes 9 of the opposite side frames 6. Also the strap-insertion bar 3 has a rectangular strap-insertion through-hole 11 extending over the majority of its entire length so that the strap 4 may be inserted through the strap-insertion through-hole 11. A connecting ring 7 projects from an outer surface of a central frame 5 of the U-shaped bracket 1 for being attached to the slider body S. The steps of threading the strap 4 through the U-shaped bracket 1 are substantially similar to that of the first embodiment, which are discussed in connection with FIGS. 3A through 3D.

Figure 5:
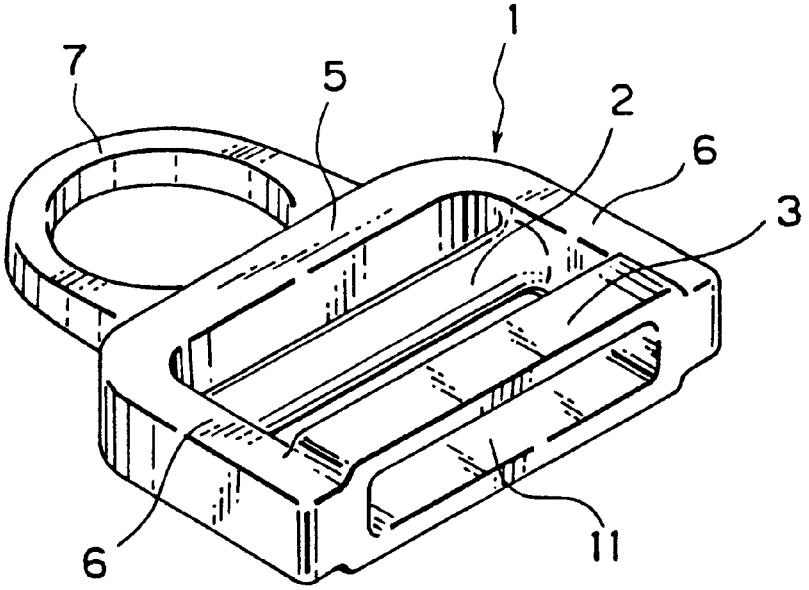
FIG. 5 is a perspective view of still another pull-tab connector according to a third embodiment of the invention.

FIG. 5 shows still another pull-tab connector according to a third embodiment. This embodiment is identical with the first embodiment of FIG. 1 except that both of the strap-turning bar 2 and the strap-insertion bar 3 are fixed at opposite ends to opposite side frames 6 of a modified U-shaped bracket 1 of the connector, which is devoid of a slot and the pivot hole in either side frame 6. Likewise the first embodiment, the strap-insertion bar 3 has a rectangular strap-insertion through-hole 11 extending over the majority of its entire length so that the strap 4 may be inserted through the strap-insertion through-hole 11. A connecting ring 7 projects from an outer surface of a central frame 5 of the U-shaped bracket 1 for being attached to the slider body S. The steps of threading the strap 4 through the U-shaped bracket 1 are substantially similar to that of the first embodiment, which are discussed in connection with FIGS. 3A through 3D.

Figure 6:
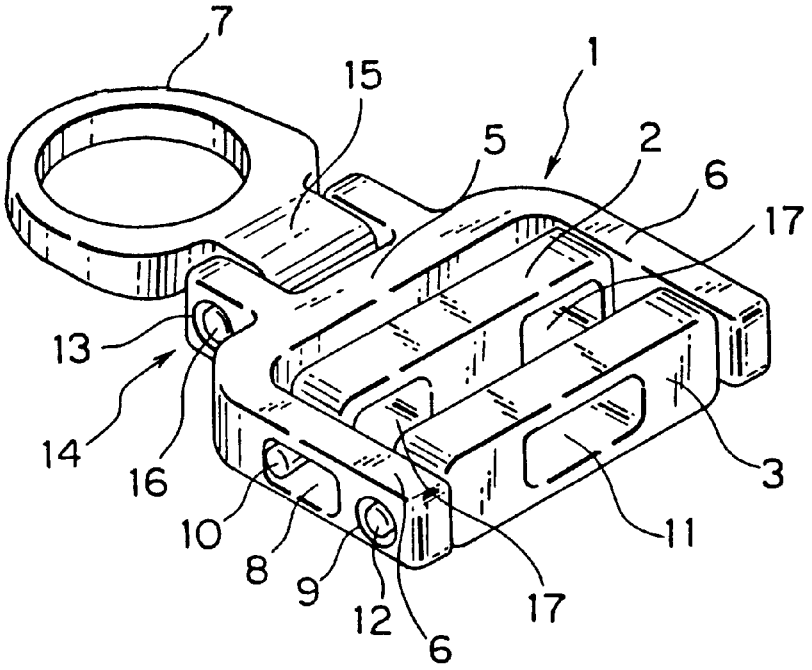
FIG. 6 is a perspective view of still another pull-tab connector according to a fourth embodiment of the invention.

FIG. 6 shows still another pull-tab connector according to a fourth embodiment, which is suitable for use with a round strap. This embodiment is differentiated from the first embodiment of FIG. 1 in that a modified U-shaped bracket 1 has a pair of parallel bearing lugs 14 projecting from an outer surface of a central frame 5 of the U-shaped bracket 1. A connecting ring 7 to be attached to the slider body S is pivotally supported on the bearing lugs 14 by a pair of pivots 16 projecting from opposite ends of a ring neck 15 of the ring 7. The pivots 16 are rotatably received in respective pivot holes 13 of the bearing lugs 14.

Regarding the remaining structure of the pull-tab connector of this embodiment is identical with the first embodiment of FIG. 1 except for the strap-turning bar 2 and the strap-insertion bar 3. Namely, in this embodiment, the strap-turning bar 2 of a rectangular cross section has a pair of laterally spaced small-width rectangular though-holes 17 through which the round strap 4 is to be inserted. On the other hand, the strap-insertion bar 3 has a modified rectangular strap-insertion through-hole 11, which is slightly larger in size than the through-holes 17 of the strap-turning bar 2, so that the round strap 4 may be inserted through the strap-insertion through-hole 11. Also the strap-insertion through-hole 11 is smaller in width than that of the first embodiment and is located at a position toward the center as compared to the through-holes 17 of the strap-turning bar 2 so that the inserted round strap 4 is avoided from being laterally displaced or spread apart. Alternatively, either the through-holes 17 of the strap-turning bar 2 or the strap-insertion through-hole 11 may be circular or oval.

Figure 7:
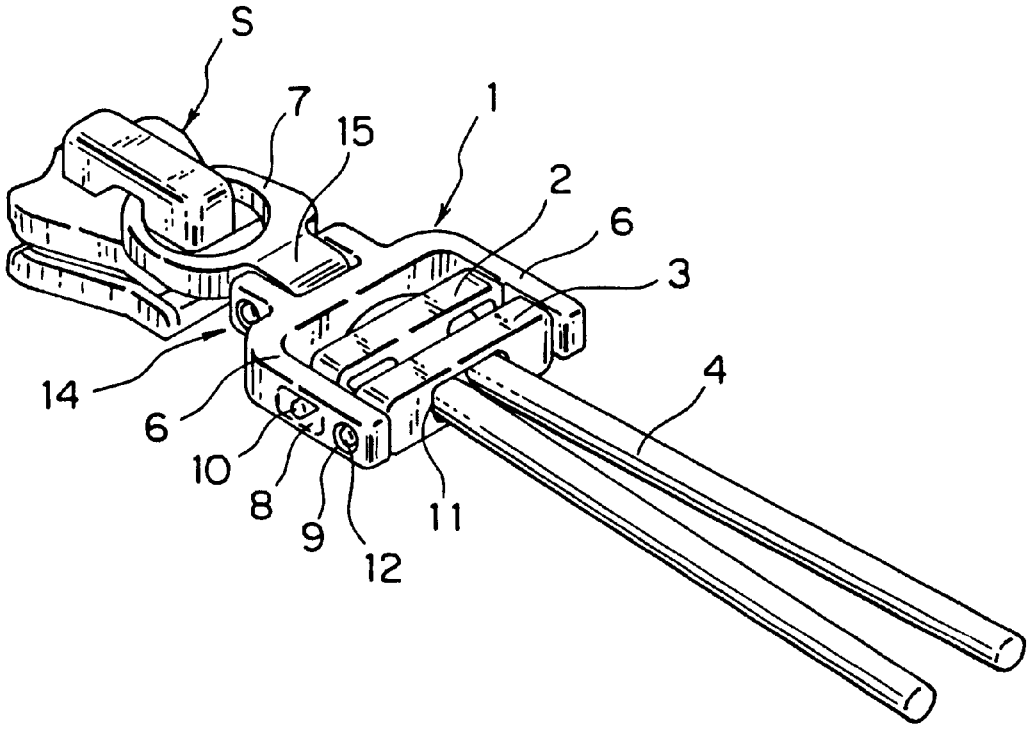
FIG. 7 is a perspective view showing the pull-tab connector of e fourth embodiment as attached to the slider.

The steps in which the round strap 4 is threaded through the U-shaped bracket 1 of this embodiment will now be described with reference to FIG. 7. Firstly a leading end of the round strap 4 is inserted through the strap-insertion through-hole 11 of the strap-insertion bar 3 and through one of the two through-holes 17 of the strap-insertion bar 3 as the strap-turning bar 2 and the strap-insertion bar 3 are angularly moved. Then the leading end of the round strap 4 is inserted through the other through-hole 17 of the strap-turning bar 2, turning around the inter-hole portion of the strap-turning bar 2, and is inserted again through the through-hole 11 of the strap-insertion bar 3. Finally, the leading end of the round strap 4 is drawn outwardly from the strap-insertion bar 3 until it comes into lateral alignment with its trailing end, whereupon the aligned opposite ends of the round strap 4 are pulled away from the pull-tab connector to complete the assembling of the pull tab as shown in FIG. 7.

Figure 8:
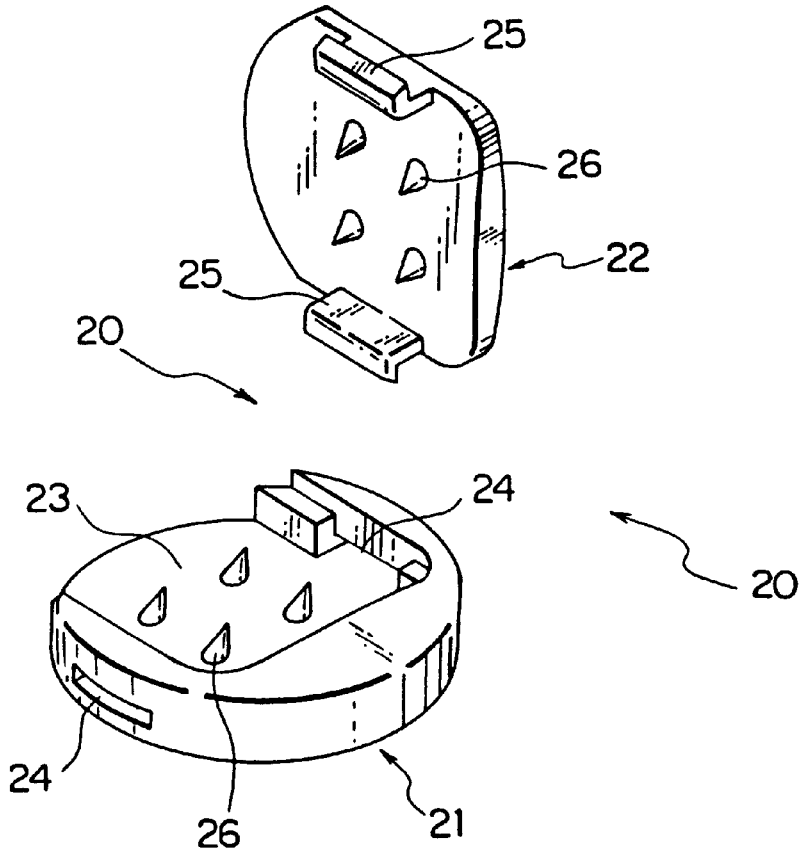
FIG. 8 is an exploded perspective view of a clamp member for fastening free ends of the strap.
Figure 9:
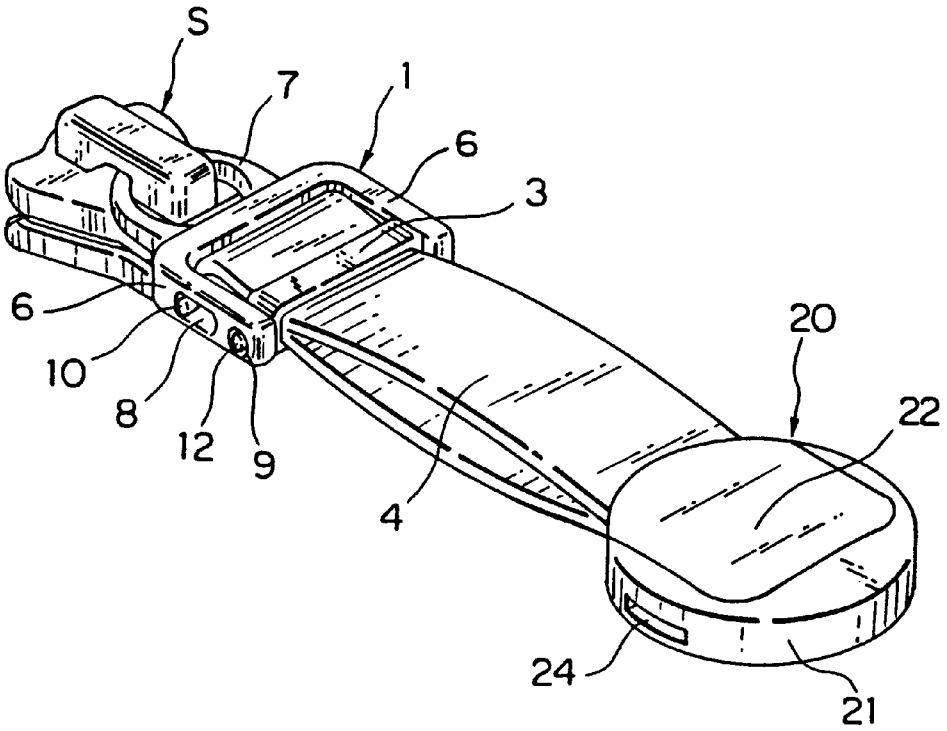
FIG. 9 is a perspective view showing the pull-tab connector of the first embodiment with free ends of the strap being fastened by the clamp member of FIG. 8.

FIG. 8 shows a clamp member 20 as a fastener for clamping the opposite ends of the strap 4 threaded through the U-shaped bracket 1 as shown in FIG. 9. The clamp member 20 is composed of a base 21 and a holder plate 22 for clamping the opposite ends of the strap 4 between them. The holder plate 22 has a pair of resilient angled legs 25 while the base 21 has a pair of catch holes 24 engageable with the angled legs 25 in a snap action when the holder plate 22 and the base 21 are pressed toward each other to assume a closed posture as shown in FIG. 9. Further, the base 21 has a recess 23 for receiving the opposite ends of the strap 4 and a plurality of spikes 26 on a bottom of the recess 23 for biting into the opposite ends of the strap 4 when the strap ends are clamped between the base 21 and the holder plate 22.

Figure 10:
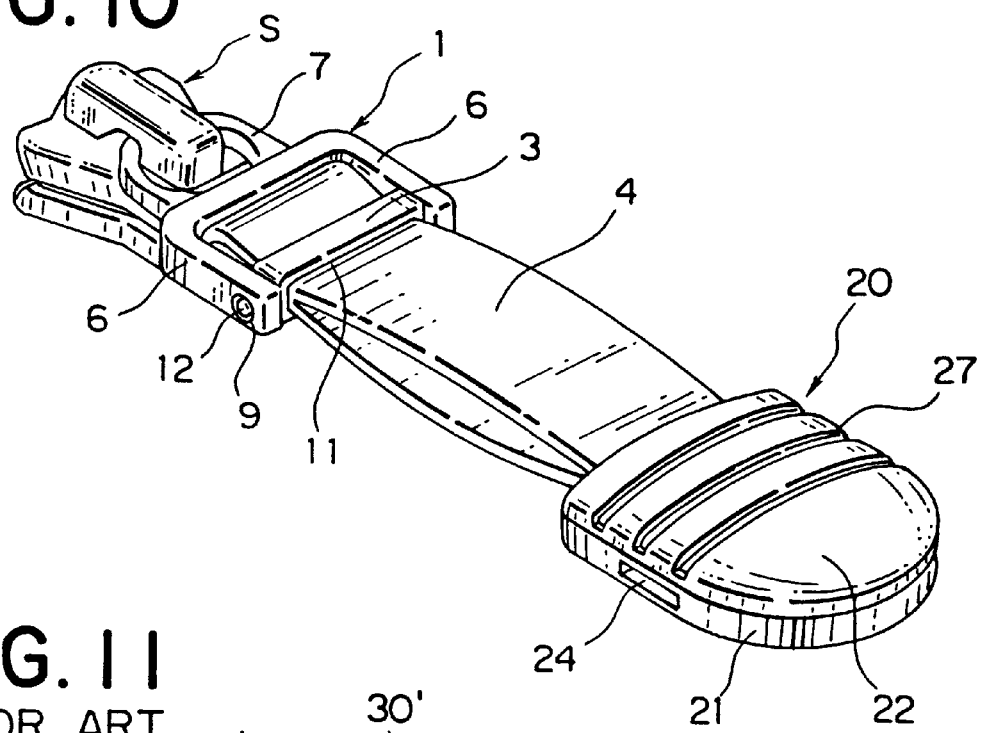
FIG. 10 is a perspective view similar to FIG. 9, but showing a modified clamp member fastening the free ends of the strap.
Figure 11:
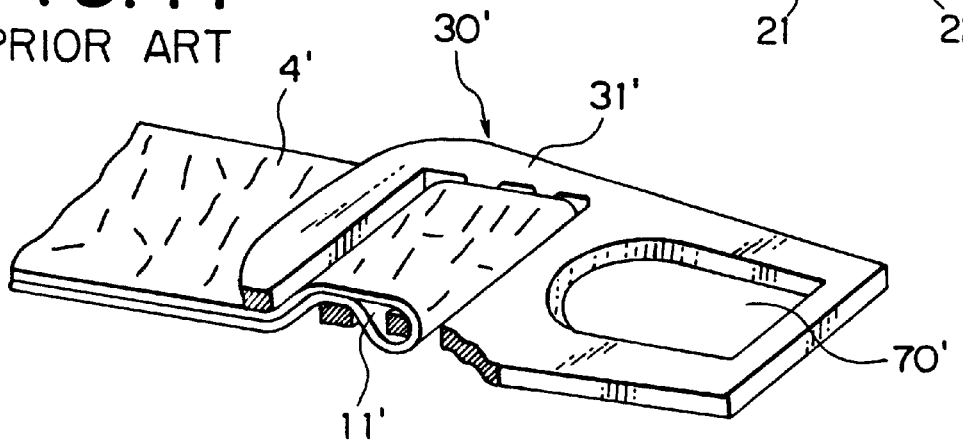
FIG. 11 PRIOR ART
FIG. 11 is a fragmentary perspective view of a conventional pull tab using a strap.
Figure 12:
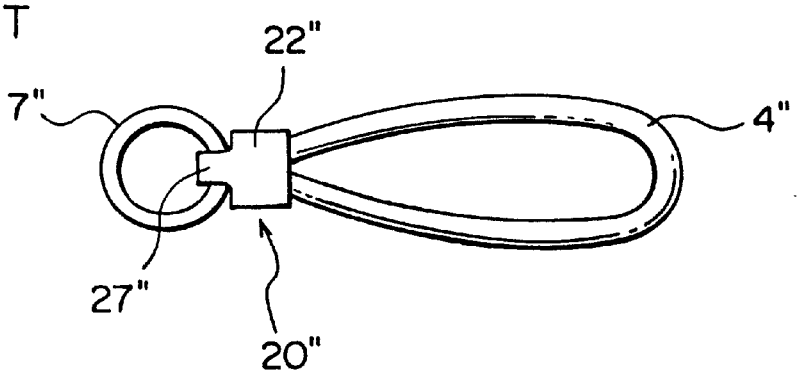
FIG. 12 PRIOR ART
FIG. 12 is a plan view showing another conventional pull tab using a strap.

FIG. 10 is a perspective view similar to FIG. 9, but showing a modified clamp member 20. In this modified clamp member 20, the contact surfaces of the base 21 and the holder plate 22 are identical, and the base 21 and/or the holder plate 22 have/has on its outer surface a plurality of lines of lateral grooves so that the pull tab can be gripped by fingers without skidding.

The pull-tab connector for a slide fastener slider of the present invention has the following advantageous results.

According to the first aspect of the invention, partly since the connecting ring 7 is connected to the outer surface of the central frame 5 of the U-shaped bracket 1, and partly since the strap-turning bar 2 and the strap-insertion bar 3 which has a strap-insertion through-hole 11 are supported by opposite side frames 6 of the U-shaped bracket 1, a flat or round strap 4 can be attached to the slider body S in a simple operation and the attached strap 4 can be exchanged with another simply as desired, though the connector is simple in structure.

According to the second aspect of the invention, since the strap-insertion bar 3 is rotatably supported on the opposite side frames 6 of the U-shaped bracket 1 for rotation about its own axis, the strap 4 can be threaded through the U-shaped bracket 1 simply and smoothly as the strap-insertion bar 3 is free to rotate.

According to the third aspect of the invention, since the strap-turning bar 2 is rotatably and slidably supported on the opposite side frames 6 of the U-shaped bracket 1, the strap 4 can be threaded through and turned in the U-shaped bracket simply and smoothly as the strap-turning bar is free to slide and rotate.

According to the fourth and fifth aspects of the invention, since the strap-turning bar 2 and/or the strap-insertion bar 3 are/is fixed to the opposite side frames 6 of the U-shaped bracket 1, the strap 4 can be threaded and turned in the U-shaped bracket 1 in a stable posture.

According to the sixth aspect of the invention, since the strap-turning bar 2 has a pair of laterally spaced second strap-insertion holes 17 through which the strap 4 is to be inserted, and the strap-insertion bar 3 has a central strap-insertion hole 11 slightly larger than one of the through-hole 17, each of the strap-turning bar 2 and the strap-insertion bar 3 supported by the U-shaped bracket 1 has a structure suitable for threading a round strap 4 in a stable and neat manner.

According to the seventh aspect of the invention, since the central frame 5 of the U-shaped bracket 1 has on its outer surface a pair of bearing lugs 14 on which the connector ring 7 is pivotally supported, the pull-tab connector through which the strap 4 has been threaded can be attached to the slider body S simply and operation and handling of the slider can be facilitated.

According to the eighth aspect of the invention, partly since the pull tab includes a strap-end clamp member 20 composed of a base 21 and a holder plate 22, and partly since the strap 4 is threaded through the strap-insertion and strap-turning bars 3, 2 of the U-shaped bracket 1 and turned by the strap-turning bar 2 and is clamped at its ends between the base 21 and holder plate 22 of the strap-end clamp member 20, free ends of the strap 4 threaded through and turned in the U-shaped bracket 1 can be neatly and fixedly held by the clamp member 20, facilitating pulling the slider.

According to the ninth aspect of the invention, since the holder plate 22 has a pair of resilient angled legs 25 and the base 21 has a pair of catch holes 24 engageable with the angled legs 25, free ends of the strap 4 threaded through and turned in the U-shaped bracket 1 can be neatly and fixedly held by a clamp in a simple snap action.

According to the tenth aspect of the invention, since the base 21 and/or the holder plate 22 has on its inner surface a plurality of spikes for biting into the strap 4 when the base 21 and the holder plate 22 are pressed toward each other to clamp the strap 4, free ends of the strap 4 threaded through and turned in the U-shaped bracket 1 can be neatly and fixedly held by the clamp member 20 without accidental removal.

According to the eleventh aspect of the invention, since the base 21 and/or the holder plate 22 has on its outer surface a plurality of lines of lateral grooves, the pull tab can be gripped by fingers without skidding.

What is claimed is:

1. A pull-tab connector for connecting a strap of a pull tab to a slide fastener slider, comprising:

(a) a U-shaped bracket having a pair of opposite side frames extending in a longitudinal direction and a central frame extending between said opposite side frames;

(b) a connector ring connected to an outer surface of said central frame of said U-shaped bracket, said connector ring being adapted to be attached to a pull-tab attachment lug of the slide fastener slider;

(c) a strap-turning bar supported by said U-shaped bracket centrally between said opposite side frames for turning the strap around said strap-turning bar; and (d) a first strap-insertion bar supported by said U-shaped bracket between respective free ends of said opposite side frames and having top and bottom walls separated by a first strap-insertion through hole extending in the longitudinal direction from an outer end portion of said U-shaped bracket opposite said central frame toward said strap-turning bar.

2. A pull-tab connector according to claim 1, wherein said strap-insertion bar is rotatably supported on said opposite side frames of said U-shaped bracket for rotating about its own axis.

3. A pull-tab connector according to claim 1, wherein said opposite side frames of said U-shaped bracket have a pair of slots in which said strap-turning bar is slidably and rotatably received.

4. A pull-tab connector according to claim 1, wherein said strap-turning bar is fixed to said opposite side frames of said U-shaped bracket.

5. A pull-tab connector according to claim 1, wherein said strap-insertion bar is fixed to said opposite side frames of said U-shaped bracket.

6. A pull-tab connector according to claim 1, wherein said strap-turning bar has a pair of laterally spaced second strap-insertion holes through which the strap is to be inserted.

7. A pull-tab connector according to claim 1, wherein said central frame of said U-shaped bracket has on its outer surface a pair of bearing lugs op which said connector ring is pivotally supported.

8. A pull-tab connector according to claim 1, wherein said pull tab further includes a strap-end clamp member composed of a base and a holder plate, and said strap is to be threaded through said strap turning and strap-insertion bars of said U-shaped bracket and turned by said strap-turning bar and is to be clamped at its ends between said base and holder plate of said strap-end clamp.

9. A pull-tab connector according to claim 8, wherein said holder plate has a pair of resilient angled legs and said base has a pair of catch holes engageable with said angled legs.

10. A pull-tab connector according to claim 8, wherein said base and/or said holder plate have/has on its inner surface a plurality of spikes for biting into said strap when said base and said holder plate are pressed toward each other to clamp said strap.

11. A pull-tab connector according to claim 8, wherein said base and/or said holder plate have/has on its outer surface a plurality of lateral grooves.

12. A pull-tab connector for connecting a strap of a pull tab to a slide fastener slider, comprising:

(a) a U-shaped bracket having a pair of opposite side frames and a central frame extending between said opposite side frames;

(b) a connector ring connected to an outer surface of said central frame of said U-shaped bracket, said connector ring being adapted to be attached to a pull-tab attachment lug of the slide fastener slider;

(c) a strap-turning bar supported by said U-shaped bracket centrally between said opposite side frames for turning the strap around said strap-turning bar; and (d) a strap-insertion bar supported by said U-shaped bracket between respective free ends of said opposite side frames and having a strap-insertion through-hole which the strap is to be insert; and (e) said strap-insertion bar is rotatably supported on said opposite side frames of said U-shaped bracket for rotating about its own axis.

* * * * *